US007572161B2

(12) United States Patent
Mackal et al.

(10) Patent No.: US 7,572,161 B2
(45) Date of Patent: Aug. 11, 2009

(54) BOBBIN FOR AUTOMATIC INFLATOR

(75) Inventors: Glenn H. Mackal, St. Petersburg, FL (US); Lyman W. Fawcett, Jr., St. Petersburg, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 3 days.

(21) Appl. No.: 10/681,580

(22) Filed: Oct. 6, 2003

(65) Prior Publication Data

US 2004/0124209 A1 Jul. 1, 2004

Related U.S. Application Data

(62) Division of application No. 09/948,646, filed on Sep. 7, 2001, now Pat. No. 6,705,488.

(51) Int. Cl.
*B63C 9/125* (2006.01)
*G07F 13/00* (2006.01)
*B67D 5/08* (2006.01)

(52) U.S. Cl. ..... 441/95; 222/5; 222/54; 424/467

(58) Field of Classification Search ..... 222/5, 222/54; 424/467; 441/8, 95, 97, 100
See application file for complete search history.

(56) References Cited

U.S. PATENT DOCUMENTS

| | | | | | |
|---|---|---|---|---|---|
| 2,701,886 | A | * | 2/1955 | Ivie | 441/95 |
| 2,894,658 | A | * | 7/1959 | Spidy | 441/95 |
| 2,964,050 | A | * | 12/1960 | Novak | 441/97 |
| 3,059,814 | A | | 10/1962 | Poncel et al. | 222/5 |
| 3,091,782 | A | | 6/1963 | Sclafani | 9/316 |
| 3,113,076 | A | | 12/1963 | Jacobs | 167/82 |
| 3,279,995 | A | | 10/1966 | Reid | 167/82 |
| 3,308,494 | A | * | 3/1967 | Licher | 441/97 |
| 3,426,942 | A | | 2/1969 | McMains et al. | 222/5 |
| 3,579,964 | A | | 5/1971 | Ohlestein | 222/5 |
| 3,702,014 | A | | 11/1972 | Rabon et al. | 9/8 |
| 3,723,614 | A | | 3/1973 | Langauer | 424/15 |
| 3,757,371 | A | | 9/1973 | Martin | 9/316 |
| 3,802,012 | A | | 4/1974 | Middleton | |
| 3,809,288 | A | | 5/1974 | Mackal | |
| 3,910,457 | A | | 10/1975 | Sutliff et al. | 222/5 |
| 3,997,079 | A | | 12/1976 | Niemann | 222/5 |
| 4,223,805 | A | | 9/1980 | Mackal | 222/5 |
| 4,260,075 | A | | 4/1981 | Mackal | 222/5 |
| 4,267,944 | A | | 5/1981 | Mackal | 222/5 |
| 4,382,231 | A | | 5/1983 | Miller | 324/439 |
| 4,436,159 | A | | 3/1984 | Revay | 169/28 |
| 4,488,546 | A | | 12/1984 | Bernhardt et al. | 128/201.23 |
| 4,513,248 | A | | 4/1985 | Miller | 324/439 |
| 4,627,823 | A | | 12/1986 | Mackal | 441/95 |

(Continued)

FOREIGN PATENT DOCUMENTS

| | | |
|---|---|---|
| DE | 1117433 | 11/1961 |

(Continued)

*Primary Examiner*—Kevin P Shaver
*Assistant Examiner*—Melvin A Cartagena
(74) *Attorney, Agent, or Firm*—Gray Robinson, P.A.

(57) ABSTRACT

An automatic inflator comprising a body for receiving a dissolvable pill, said dissolvable pill including an upper surface and a lower surface, at least one of said surfaces including an undulating configuration.

3 Claims, 8 Drawing Sheets

U.S. PATENT DOCUMENTS

| | | | | |
|---|---|---|---|---|
| 4,816,262 | A | 3/1989 | McMullen | 424/467 |
| D304,244 | S | 10/1989 | Tovey | D28/2 |
| 5,076,468 | A | 12/1991 | Mackal | 222/5 |
| 5,333,756 | A | 8/1994 | Glasa | 222/5 |
| 5,370,567 | A | 12/1994 | Glasa | 441/95 |
| 5,562,233 | A | 10/1996 | Glasa | 222/5 |
| 5,592,962 | A * | 1/1997 | Hooberman | 137/68.22 |
| 5,601,124 | A | 2/1997 | Weinheimer | 141/19 |
| 5,685,455 | A | 11/1997 | Glasa | 222/5 |
| 5,694,986 | A | 12/1997 | Weinheimer et al. | 141/19 |
| D424,686 | S | 5/2000 | Lam | D24/103 |
| 6,705,488 | B2 * | 3/2004 | Mackal et al. | 222/5 |

FOREIGN PATENT DOCUMENTS

| | | |
|---|---|---|
| DE | 1242469 | 6/1967 |
| EP | 0198805 | 10/1986 |
| EP | 93309156.3 | 5/1994 |

* cited by examiner

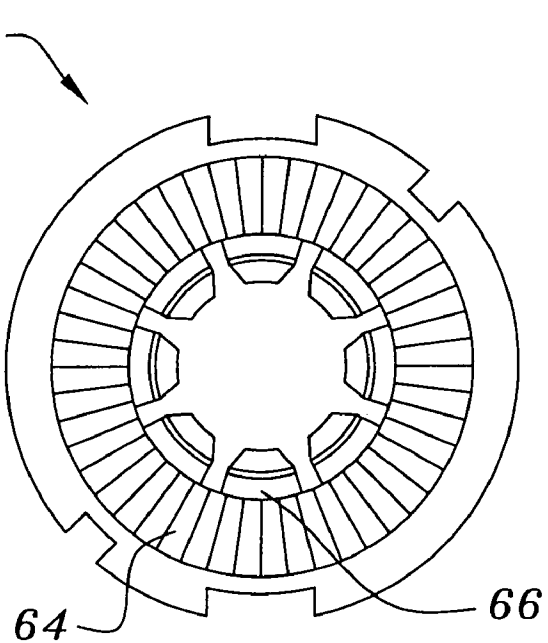
FIG. 1A
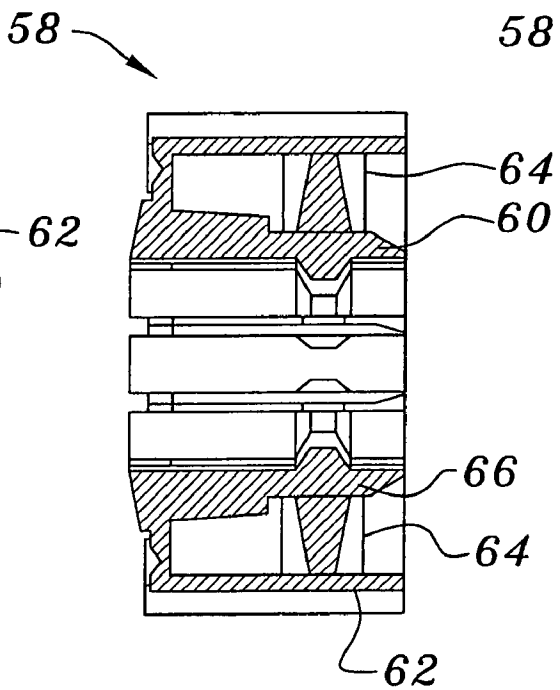
FIG. 1C
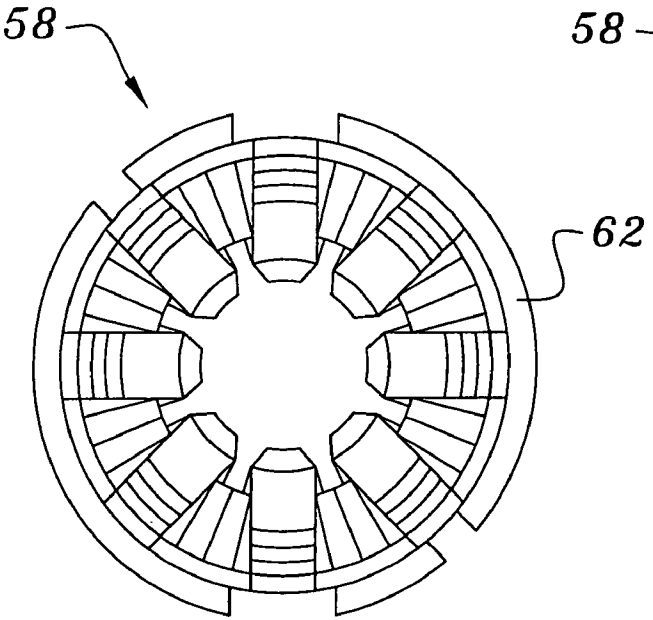
FIG. 1B
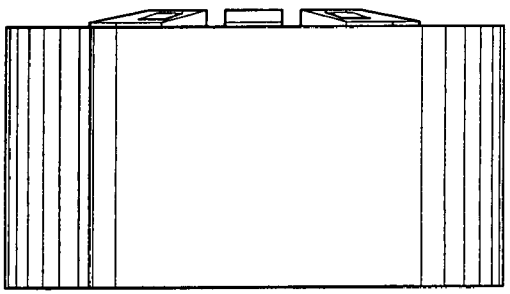

BOBBIN FOR AUTOMATIC INFLATOR

CROSS-REFERENCE TO RELATED APPLICATIONS

This application is a divisional of application Ser. No. 09/948,646, filed Sep. 7, 2001, now U.S. Pat. No. 6,705,488 the disclosure of which is hereby incorporated by reference herein.

BACKGROUND OF THE INVENTION

1. Field of the Invention

This invention relates to automatic inflators for inflatable articles such as life rafts, life vests, and the like. More particularly, this invention relates to inflators that are actuated automatically upon immersion in water.

2. Description of the Background Art

Presently, there exists many types of inflators designed to inflate inflatable articles such as personal floatation devices (life vests, rings and horseshoes), life rafts, buoys and emergency signaling equipment. Manual inflators typically comprise a body for receiving the neck of a cartridge of compressed gas such as carbon dioxide. A reciprocating piercing pin is disposed within the body of the inflator for piercing the frangible seal of the cartridge to permit compressed gas therein to flow into a manifold assembly of the inflator and then into the article to be inflated. Typically, a manually movable firing lever is operatively connected to the piercing pin such that the piercing pin pierces the frangible seal of the gas cartridge upon jerking of a ball lanyard. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or a man overboard, would fail or be unable to manually activate the inflator. Accordingly, it was realized that a means should be provided for automatically activating the inflator in such an emergency situation.

In response to this realized inadequacy of the prior art manual inflators, water-activated automatic inflators were developed which, when exposed to a fluid such as water, automatically activated the piercing pin of the inflator when immersed in water thereby causing inflation of the inflatable device. Typical water-activated automatic inflators comprise a water activated trigger assembly including a water destructible or dissolvable element, often referred to as a "bobbin", which retains a spring-loaded actuator pin in a cocked position in alignment with a piercing pin. Upon exposure to water, the "pill" contained within the bobbin immediately starts dissolving and then destructs altogether once it loses sufficient rigidity and therefore the bobbin loses its ability to hold-back the spring-loaded actuator pin in its cocked position. The spring-loaded actuator pin is thus released to forcibly move from its cocked position to an actuated position to strike the piercing pin, either directly or indirectly by means of an intermediate transfer pin. Upon striking the piercing pin, the pin fractures the seal of the cartridge thereby allowing the gas contained therein to flow into the inflatable device to inflate the same. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, 5,076,468, 5,601,124, 5,685,455, 5,562,233, 5,370,567, 5,333,756, 4,488,546 and 5,694,986, the disclosures of which are hereby incorporated by reference herein.

While the above referenced automatic inflators operate quite well in inflating inflatable devices in the event of an emergency situation, one major disadvantage to these automatic inflators is the tendency of their bobbins to prematurely destruct in non-emergency situations by exposure of the pill contained therein to excessive humidity. Bobbin pills of various designs and chemical compositions have been used to minimize their susceptibility to humidity. Indeed, the problem of premature and unintentional activation of automatic inflators is so acute that it is not uncommon for the water-destructible bobbins of the automatic inflators to be replaced on a regular basis as part of a periodic maintenance program, particularly when the inflators are employed in humid weather conditions or around water. In this regard, it is noted that each of the prior art water-activated automatic inflators disclosed in the above referenced patents teach a structure which may easily be disassembled to facilitate the replacement of the water destructible bobbin so that the inflator may be periodically maintained by replacing the bobbin. In order to minimize such periodic maintenance, there therefore exists a need for an improved bobbin pill that is less susceptible to humid weather conditions and yet retains its ability to immediately dissolve upon being immersed in water.

Therefore, it is an object of this invention to provide an improvement which overcomes the aforementioned inadequacies of the prior art devices and provides an improvement which is a significant contribution to the advancement of the inflation art.

Another object of this invention is to provide an improved bobbin pill design for an automatic inflator that is less susceptible to humid weather conditions that may prematurely activate the automatic inflator in non-emergency situations.

Another object of this invention is to provide an improved bobbin pill design for an automatic inflator that provides sufficient strength to retain the actuator pin in its cocked position and thereby minimize premature activation of the automatic inflator in non-emergency situations.

Another object of this invention is to provide an improved bobbin pill design for a bobbin of an automatic inflator that comprises at least one surface having an undulating configuration having an increased strength to hold-back the spring-loaded actuator pin and an increased surface area to facilitate dissolving once exposed to water to thereby be less susceptible to humid weather conditions that may otherwise result in the premature activation of the automatic inflator in non-emergency situations.

Another object of this invention is to provide an improved bobbin pill design for an automatic inflator that comprises a surface having an undulating configuration applied to opposing surfaces of the bobbin pill, with the opposing undulations being aligned with respect to each other to maximize the increased strength to hold-back the spring-loaded actuator pin while still being capable of easily dissolving once exposed to water to thereby be less susceptible to humid weather conditions that may otherwise result in the premature activation of the automatic inflator in non-emergency situations.

Another object of this invention is to provide an improved bobbin pill design of various shapes such as annular-shaped (flat and dome-configured) with a center hole, disk-shaped without a center hole, cylindrical-shaped, etc. for use with the respective style of automatic inflator, each such pill shape including an undulating surface configuration that increases the strength to hold-back the spring-loaded actuator pin while still being capable of easily dissolving once exposed to water to thereby be less susceptible to humid weather conditions that may otherwise result in the premature activation of the automatic inflator in non-emergency situations.

Another object of this invention is to provide an improved bobbin pill design for an automatic inflator that comprises non-uniform thickness having an increased strength to hold-back the spring-loaded actuator pin yet still being easily dissolvable once exposed to water to thereby be less susceptible to humid weather conditions that may otherwise result in the premature activation of the automatic inflator in non-emergency situations.

Another object of this invention is to provide an improved bobbin pill design of various shapes such as annular-shaped (flat and dome-configured) with a center hole, disk-shaped without a center hole, cylindrical-shaped, etc. for use with the respective style of automatic inflator, each such shape including a non-uniform thickness that increases the strength to hold-back the spring-loaded actuator pin while still being capable of easily dissolving once exposed to water.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises an improved pill of a bobbin for a water-activated automatic inflator that is less susceptible to humid weather conditions that may otherwise prematurely activate the automatic inflator in non-emergency situations. In one embodiment, the pill of the bobbin of the invention comprises at least one surface having an undulating configuration. The undulating surface configuration increases the strength of the bobbin pill to hold-back the spring-loaded actuator pin and increases the surface area to enhance dissolving once exposed to water. In another embodiment, the pill of the bobbin of the invention comprises a non-uniform thickness that is configured to increase the strength of the bobbin pill to hold-back the spring-loaded actuator pin while still being able to be easily dissolved once exposed to water. The undulating configuration and the non-uniform thickness features of the invention may be both utilized to achieve a bobbin pill having both an undulating surface configuration and a non-uniform thickness.

The pill of the bobbin may comprise various shapes, with each such shape including the undulating surface configuration and/or non-uniform configuration in accordance with the invention, such as annular-shaped with a center hole, disk-shaped without a center hole, cylindrical-shaped, etc. for use with the respective style of automatic inflator. In this manner, it should be appreciated that in accordance with the invention, the undulating surface configuration and/or the non-uniform thickness may be incorporated into virtually all bobbin pills of different shapes and therefore the invention is adaptable to virtually all existing makes and models of water-activated inflators.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which:

FIG. 1A is a distal plan view of automatic inflator's bobbin assembly having the improved pill of the invention installed therein;

FIG. 1B is a proximal plan view of FIG. 1A;

FIG. 1C is a diametric cross-sectional view of FIG. 1A;

Similar reference numerals refer to similar parts throughout the several figures.

DETAILED DESCRIPTION OF THE PREFERRED EMBODIMENT

Figure 1:
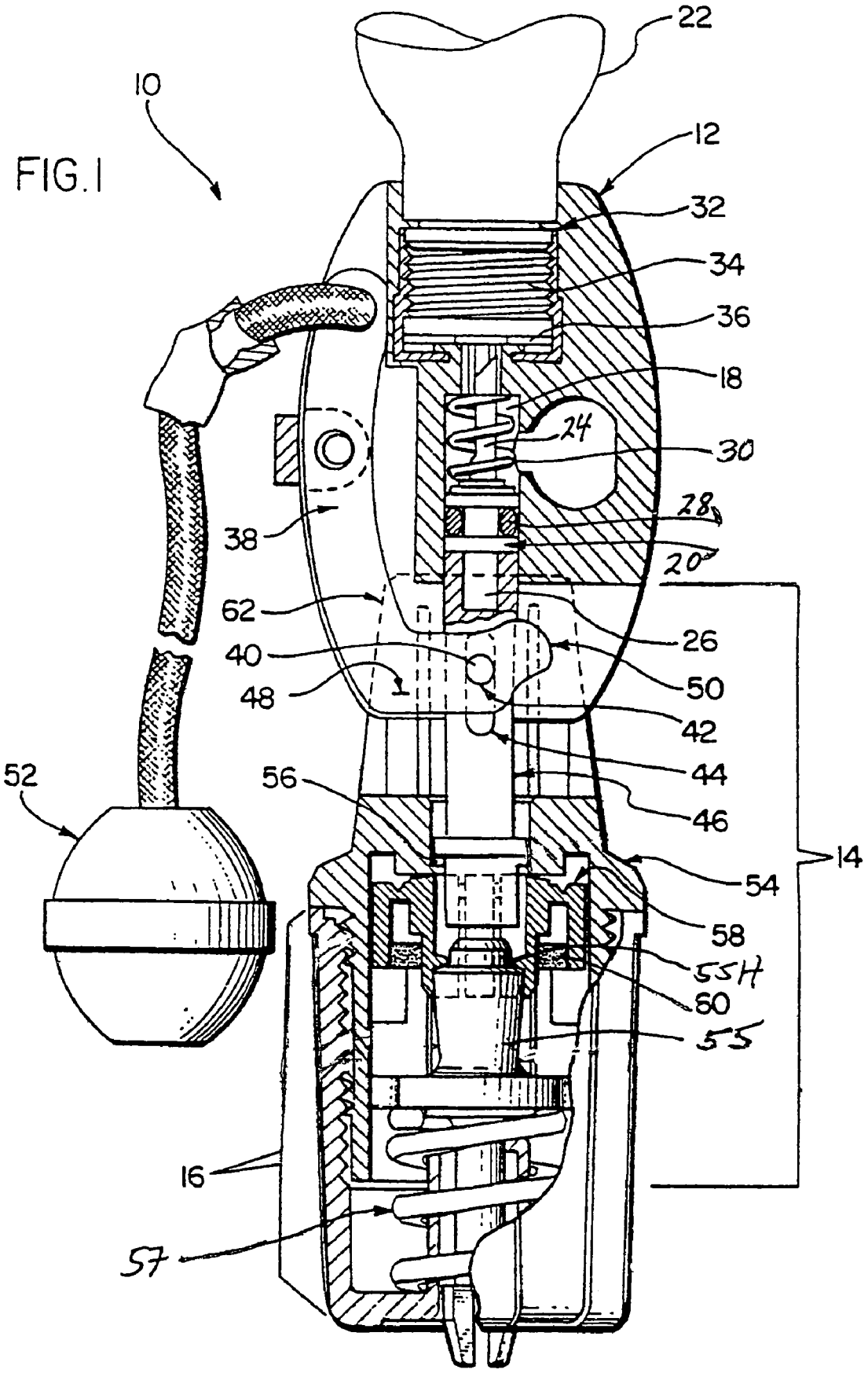
FIG. 1 is a longitudinal cross-sectional view of a particular style of an automatic inflator assembly showing the various internal parts and their relative position to one another.

FIG. 1 illustrates an exemplary automatic inflator 10 as comprising an inflator body 12, an actuator body assembly 14, and a cylindrical cap assembly 16. The inflator body 12 has a longitudinal central bore, generally indicated by numeral 18, having a proximal end and a distal end and which is sized to receive a piercing pin assembly 20 reciprocatably positioned therein so that a gas-containing cartridge 22 is pierced when the piercing pin assembly 20 is forcibly moved proximally towards the cartridge 22. The piercing pin assembly 20 comprises a piercing pin 24 having a distal end portion 26, a sealing gasket 28, and a small compression spring 30. A conventional metal insert 32, having interior threads 34 and gasket 36, is molded in situ within the upper portion of the inflator body 12. The gas-containing cartridge 22 is threaded into the metal insert 32. The gasket 36 assures that the gas-containing cartridge 22 is sealed within the metal insert 32.

The automatic inflator includes a manual actuator. As seen in FIG. 1, the manual actuator means includes a lever 38, of generally an L-shape, pivotally mounted to the distal portion of the inflator body 12 by a pivot pin 40 which passes through the inflator body 12, a hole 42 located in the distal portion of the lever 38, and a second slot portion 44 of an intermediate transfer pin 46. The distal end portion 48 of the lever 38 has a cam extension 50 which forcibly engages the distal end 28 of the piercing pin assembly 20 when the lever 38 is pulled, thereby causing the gas-containing cartridge 22 to be pierced. A lanyard handle 52 is connected to the lever 38.

The pivot pin 40 fixedly secures the actuator body assembly 14 to the inflator body 12. The actuator body assembly 14 of the invention is generally comprised of an actuator body 54, an actuator pin 55, the intermediate transfer pin 46, a conventional O-ring 56, and a bobbin assembly 58. A heavy spring 57 urges the head 55H of the actuator pin 55 forwardly against the bobbin assembly 58.

As better shown in FIGS. 1A-1C, the bobbin assembly 58 includes a generally cylindrical design with a center portion with longitudinal fingers 60 positioned parallel to each other and an outside wall portion 62. An annular-shaped bobbin pill 64 with a center hole 66 is positioned between the outside wall portion 62 and the longitudinal fingers 60 to retain the fingers 60 in their longitudinal position. So long as the longitudinal fingers 60 are retained in their parallel position by the bobbin pill 64, the tips of them form a seat for receiving the head 55H of the spring-loaded actuator pin 55 and holding the spring-loaded actuator pin 55 back against the force of the spring 57 in a "cocked" position.

However, once the bobbin pill 64 is dissolved, the longitudinal fingers 60 are allowed to flex radially outwardly under the pressure of the spring-loaded actuator pin 55. As they flex outwardly, their tips spread apart and no longer form a seat for the head 55H of the actuator pin 55, whereupon the actuator pin 55 is urged to move forwardly under the force of the spring 57 to actuate the pierce pin 20 via the transfer pin 46 (i.e., the actuator 10 is automatically "fired"). Thus, it can be appreciated that the bobbin pill 64 must have sufficient strength to hold-back the spring-loaded actuator pin 55 and yet must be dissolvable once exposed to water to allow the fingers 60 to flex radially outwardly and allow the actuator pin 55 to fire.

Figure 2A:
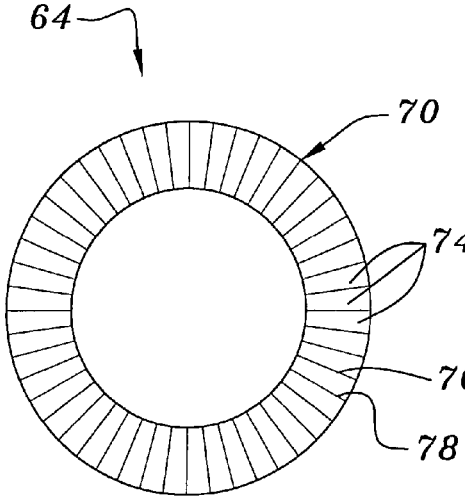
FIG. 2A is a plan view of the first embodiment of the pill design of the invention.
Figure 2B:
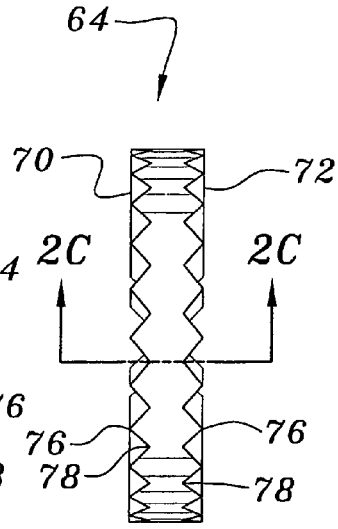
FIG. 2B is an edge view of FIG. 2A showing the first embodiment of the pill design of the invention with the undulating proximal and distal surfaces thereof, with such undulations of the distal and proximal surfaces of the pill being out-of-phase with each other.
Figure 2C:
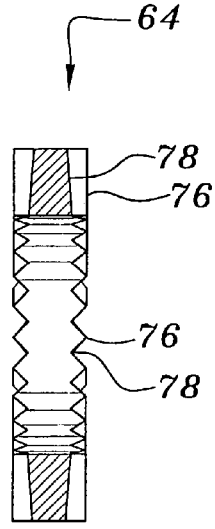
FIG. 2C is a cross-sectional view of FIG. 2B along lines 2C-2C.

The first embodiment of the bobbin pill 64 of the invention is illustrated in FIGS. 2A, 2B and 2C. As shown, the opposing distal and proximal surfaces 70 and 72 include undulations 74 with each peak 76 and trough 78 thereof extending radially from the center of the pill 64. As best shown in FIG. 2B, the undulations 24 are out of phase with respect to each other by 180 degrees such that the peaks 76 and troughs 78 of the proximal surface 72 are respectively aligned with the peaks 76 and troughs 78 of the opposing distal surface 70 (i.e., the opposing peaks 76 and troughs 78 are aligned).

Figure 3C:
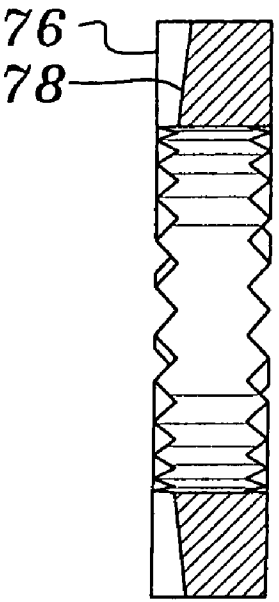
FIG. 3C is a cross-sectional view of FIG. 3B along lines 3C-3C.
Figure 3B:
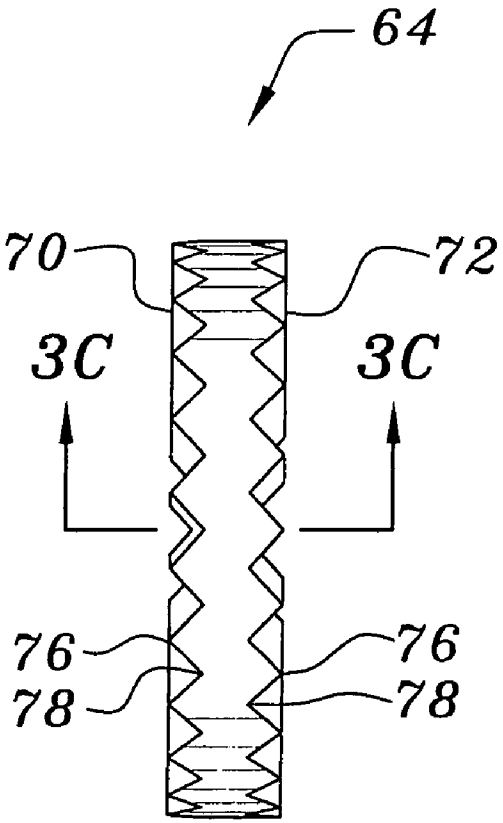
FIG. 3B is an edge view of FIG. 3A showing the cross-sectional configuration of the second embodiment of the pill design of the invention with the undulating proximal and distal surfaces thereof, with such undulations of the distal and proximal surfaces of the pill being in-phase with each other.
Figure 3A:
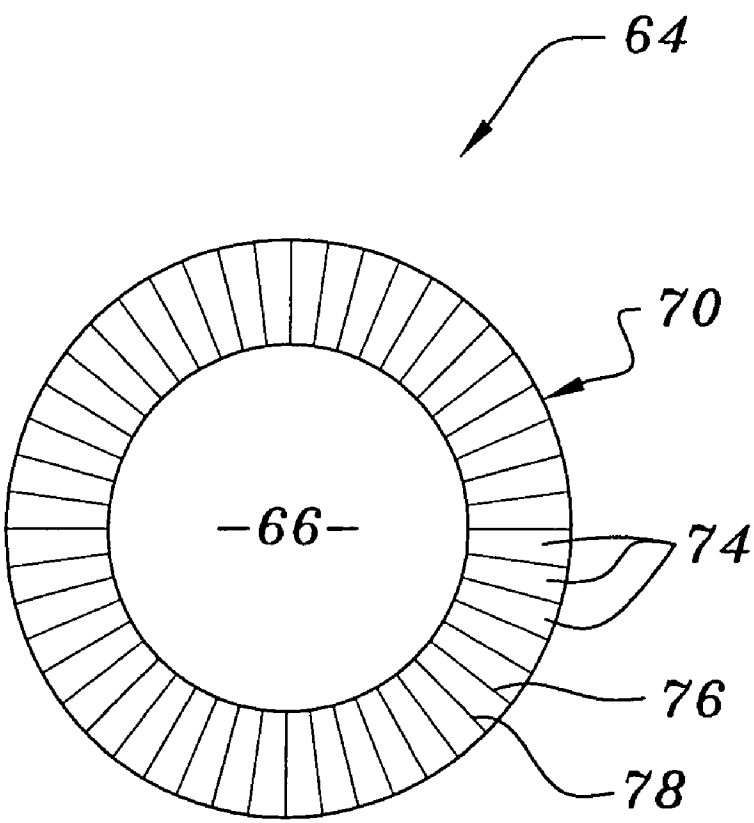
FIG. 3A is a plan view of the second embodiment of the pill design of the invention.

FIGS. 3A, 3B, and 3C illustrate the second embodiment of the bobbin pill 64 of the invention, which is similar in configuration with the first embodiment, but with the undulations 74 of the distal and proximal surfaces 70 and 72 being oriented in-phase with each other (see FIG. 3B). As such, the troughs 78 of the proximal surface 72 are aligned with the peaks 76 of the distal surface 70 and the peaks 76 of the proximal surface 72 are aligned with the troughs 78 of the distal surface 70 (i.e., the opposing peaks 76 and troughs 78 are not aligned).

The out-of-phase alignment of the undulations 74 on the distal and proximal surfaces 70 and 72 as shown in FIG. 2 is the most preferred. It is believed that the out-of-phase relative orientation provides as much compressive strength as the in-phase orientation of the second embodiment, but increases the rate of dissolving when exposed to water due to the aligned troughs 78 of the undulations 74.

It is noted that due to the annular configuration of the pill 64, the width of each of the undulations 74 formed on the surfaces 76 and 78 should narrow from the outside to the inside of the pill 64, as best shown in the respective embodiments of FIGS. 2A and 3A. In this manner, as best shown in the respective embodiments of FIGS. 2C and 3C, the distance between opposing troughs 78 (FIG. 2B) and between the opposing troughs 78 and peaks 76 is the greatest toward the center 66 of the bobbin pill 64 and radially decreases toward the outside of the pill 64. This results in a frustro-conical cross-sectional configuration (i.e., a non-uniform configuration) that achieves greater compressive strength along the lumen of the pill 60 to better withstand the forces exerted by the fingers 60 of the bobbin assembly 58.

Figure 4A:
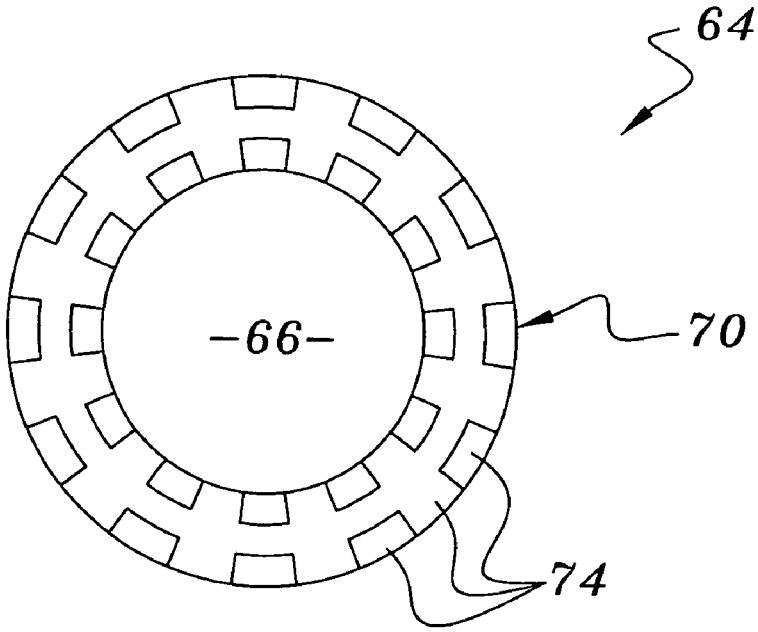
FIG. 4A is a plan view of the third embodiment of the pill design of the invention in which the undulations are in a checkerboard or quilted configuration.
Figure 4B:
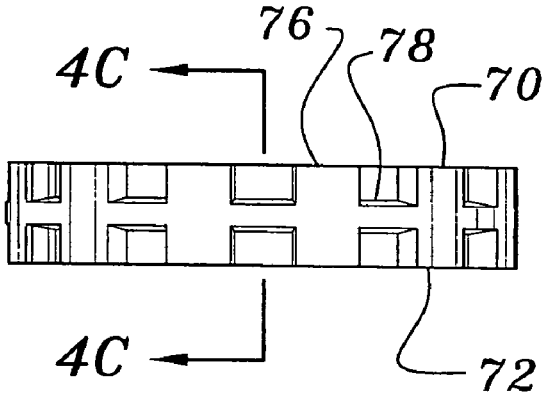
FIG. 4B is an edge view of FIG. 4A showing the third embodiment of the pill design of the invention with such checkerboard undulations of the distal and proximal surfaces of the pill being out-of-phase with each other.
Figure 4C:
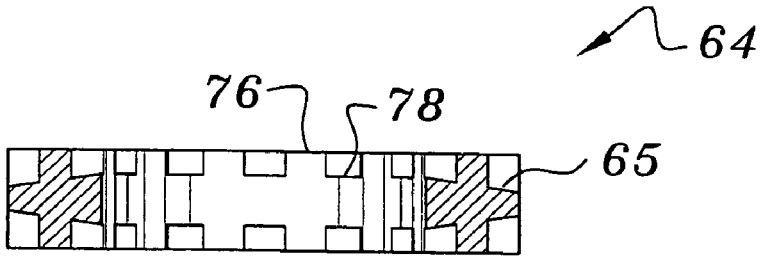
FIG. 4C is a cross-sectional view of FIG. 4B along lines 4C-4C.

FIGS. 4A, 4B, and 4C illustrate the third embodiment of the bobbin pill 64 of the invention with the undulations 74 of the distal and proximal surfaces 70 and 72 being formed in a checkerboard configuration. As shown in FIG. 4C, the pill 64 comprises a non-uniform configuration 65 including a frustro-conical cross-sectional configuration. As noted above, this achieves greater compressive strength along the lumen of the pill 60 to better withstand the forces exerted by the fingers 60 of the bobbin assembly 58. It is noted that although shown oriented out-of-phase with each other (see FIG. 4B), the undulations 74 may be aligned to be in-phase similar to the in-phase alignment of the undulations 74 of FIG. 3.

Figure 5A:
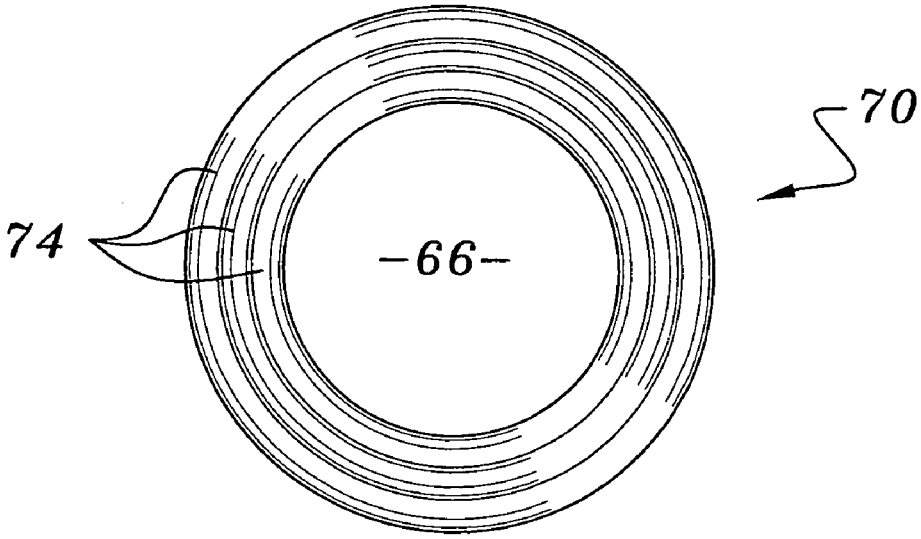
FIG. 5A is a plan view of the fourth embodiment of the pill design of the invention in which the undulations are positioned concentrically.
Figure 5B:
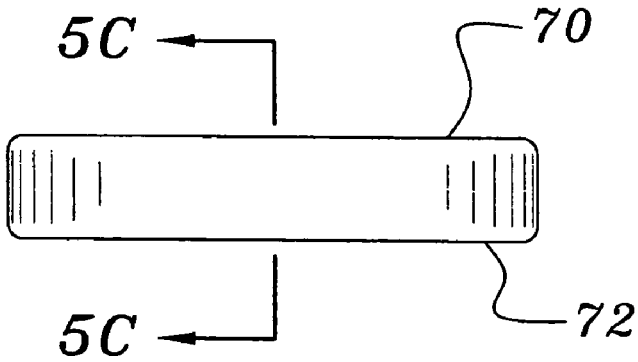
FIG. 5B is an edge view of FIG. 5A showing the fourth second embodiment of the pill design of the invention.
Figure 5C:
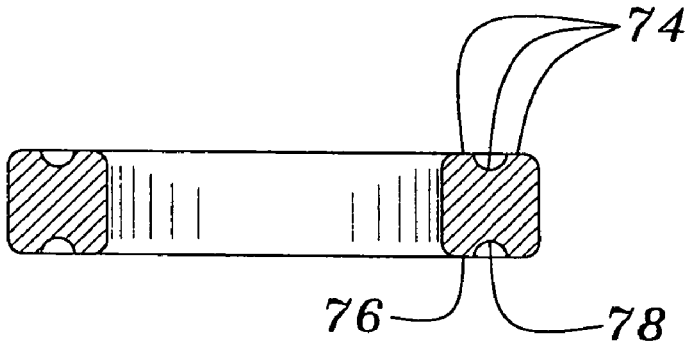
FIG. 5C is a cross-sectional view of FIG. 5B along lines 5C-5C showing the concentric undulations of the distal and proximal surfaces of the pill being out-of-phase with each other.

FIGS. 5A, 5B, and 5C illustrate the fourth embodiment of the bobbin pill 64 of the invention with the undulations 74 of the distal and proximal surfaces 70 and 72 being oriented concentrically instead of radially as shown in FIGS. 3 and 4. The concentric undulations may be aligned to be out-of-phase as shown in FIG. 5C or in-phase (not shown).

Figure 6A:
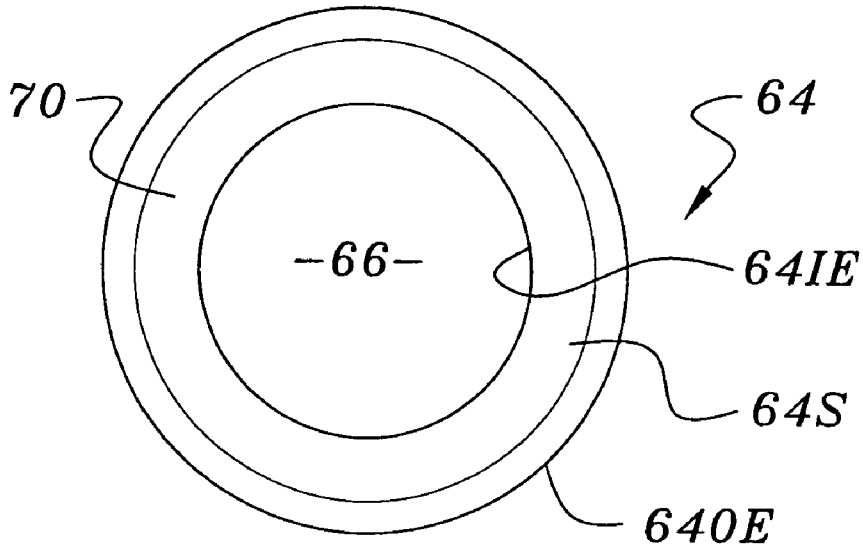
FIG. 6A is a plan view of the fifth embodiment of the pill design of the invention having a non-uniform configuration with a thicker inside edge and a thinner outside edge.
Figure 6B:
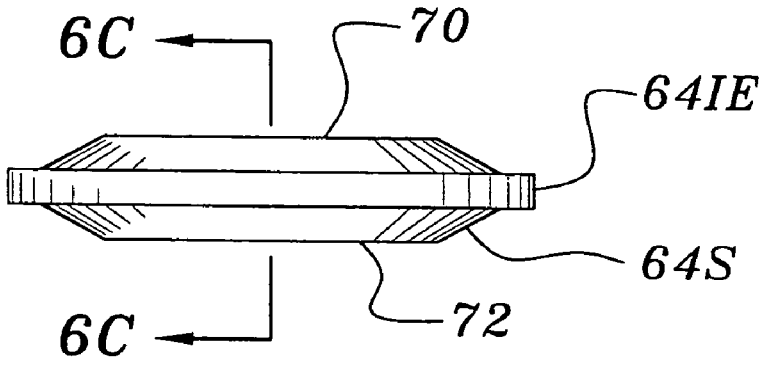
FIG. 6B is an edge view of FIG. 6A showing the fifth embodiment of the pill design of the invention.
Figure 6C:
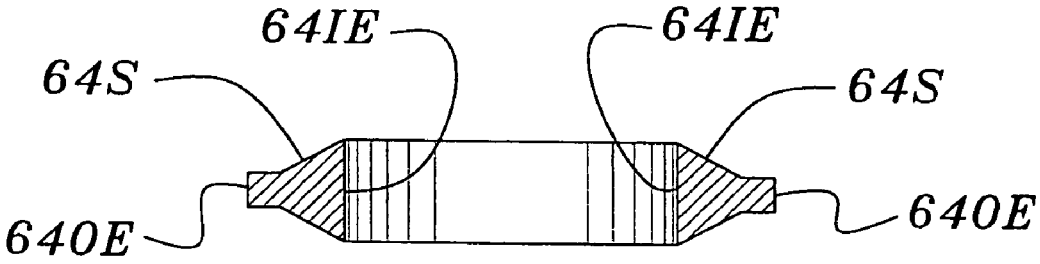
FIG. 6C is a cross-sectional view of FIG. 6B along lines 6C-6C showing the frusto-conical cross-sectional configuration of the non-uniform configuration.

FIGS. 6A, 6B, and 6C illustrate the fifth embodiment of the bobbin pill 64 of the invention having a non-uniform configuration. More specifically, as best shown in FIG. 6C, bobbin pill 64 has a generally non-uniform cross-sectional configuration having a thinner outer edge 64OE with a step 64S and a thicker inner edge 64IE that defines a generally frustro-conical cross-sectional configuration, preferably formed at a 10 degree angle. As such, the increased thickness of the pill 60 along the inside edge 64IE that engages the fingers 60 of the bobbin assembly 58 significantly increases the ability to withstand the compressive forces thereof caused by the actuator pin 55 and spring 97.

Figure 7A:
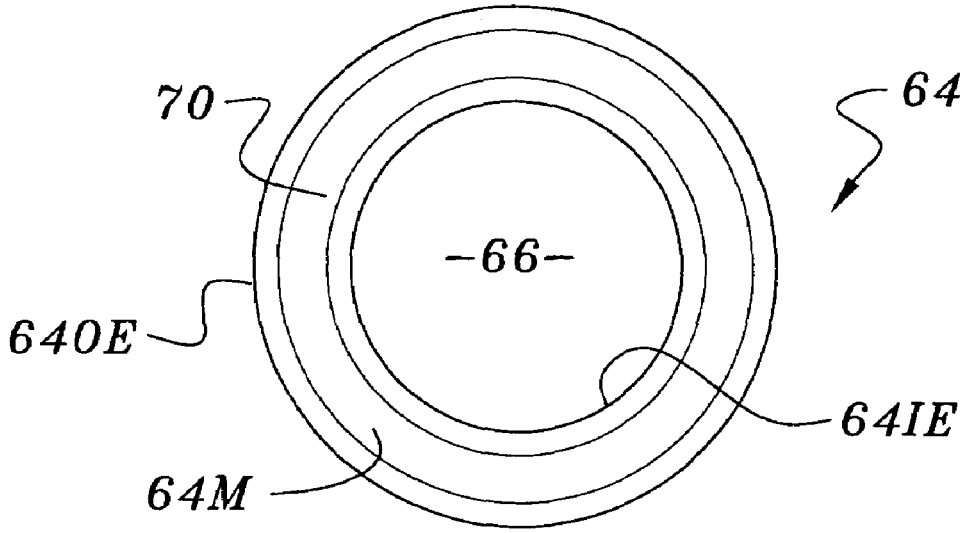
FIG. 7A is a plan view of the sixth embodiment of the pill design of the invention having a non-uniform configuration with thicker inside and outside edges and a thinner middle portion.
Figure 7B:
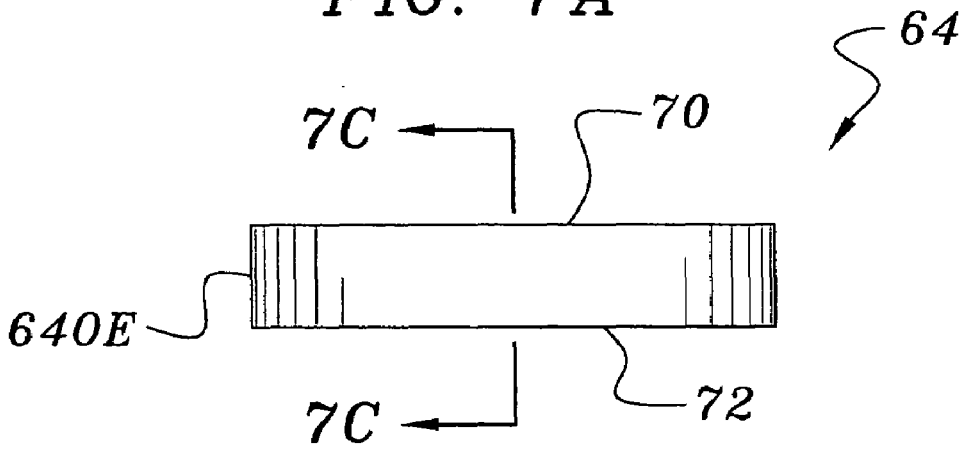
FIG. 7B is an edge view of FIG. 7A showing the sixth embodiment of the pill design of the invention.
Figure 7C:
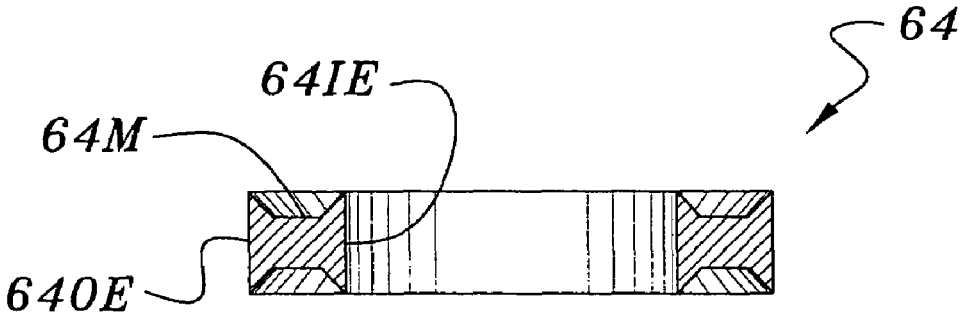
FIG. 7C is a cross-sectional view of FIG. 7B along lines 7C-7C showing the double frusto-conical cross-sectional configuration of the non-uniform configuration.

FIGS. 7A, 7B, and 7C illustrate the sixth embodiment of the bobbin pill 64 of the invention having another non-uniform configuration similar to that of the fourth embodiment but with a double frustro-conical cross-sectional configuration. More specifically, referring to FIG. 7C, the double frustro-conical cross-sectional configuration includes thicker outer and inner edges 64OE & 64IE and a thinner middle portion 64M thereby defining the double frustro-conical cross-sectional configuration. As such, the reduced thickness of the pill 64 along its middle portion assures that it will easily dissolve when immersed in water.

The foregoing detailed description has been principally directed to pills for bobbins used in automatic inflators manufactured by the assignee of this invention. However, it should be appreciated that without departing from the spirit and scope of this invention, the above-described undulations and non-uniform configurations may be applied to pills of other designs (e.g., disk-shaped without a center hole, cylindrical-shaped, etc.) of other makes or models of inflators manufactured by third parties. For example, inflators manufactured by Bernhardt Apparatebau GmbH in accordance with U.S. Pat. Nos. 5,685,455, 5,562,233, 5,370,567, 5,333,756, 4,488,546, the disclosures of which are hereby incorporated by reference herein, typically utilize a disk-shaped pill that could be, in accordance with the present invention, adapted to include the undulations and/or non-uniform configurations described herein.

The chemical composition of the pill 64 is typically composed of microcrystalline cellulose that is compressed into the desired configurations. This composition is selected for its characteristics of being resistant to moisture from humid weather conditions while maximizing compressive strength. The method of compressing the powder into the pill 64 often produces an outer surface that resembles a thin skin that enhances the pill's 64 resistance to humid weather conditions. Indeed, chemical additives may be combined with the cellulose powder to enhance the pill's 64 resistance to humidity and increase its compressed forces.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. An automatic inflator for inflating an inflatable article when the automatic inflator is submersed in a body of water, comprising a body and a dissolvable pill, said body including an actuator coupled to said pill that actuates upon dissolving of said pill to cause inflation of the inflatable article, said dissolvable pill including an upper surface and a lower surface transverse to an axis of said dissolvable pill, at least one of said surfaces including multiple undulating configurations including peaks and troughs oriented such that an imaginary plane extending through said peaks and an imaginary plane extending through said troughs extend parallel to a plane of at least one of said surfaces and transverse to said axis of said dissolvable pill, wherein both said surfaces include said undulating configurations; wherein said undulating configurations are aligned to be out of phase with each other, said undulating configurations providing sufficient strength to preclude actuation of the actuator until said undulating configuration dissolves upon becoming wetted when the inflator is submerged into the body of water.

2. The automatic inflator as set forth in claim 1, wherein said undulations extend radially.

3. The automatic inflator as set forth in claim 1, wherein said dissolvable pill comprises an annular pill with a center hole.

* * * * *